US010859305B1

(12) United States Patent
Ellis et al.

(10) Patent No.: US 10,859,305 B1
(45) Date of Patent: Dec. 8, 2020

(54) HIGH PERFORMANCE ULT CHEST FREEZER WITH DEHUMIDIFICATION

(71) Applicants: Daniel Scott Ellis, Provo, UT (US); William Grant Moon, Provo, UT (US); Steven Victor Boyce, Spanish Fork, UT (US); Steven Joseph Parkinson, Clinton, UT (US)

(72) Inventors: Daniel Scott Ellis, Provo, UT (US); William Grant Moon, Provo, UT (US); Steven Victor Boyce, Spanish Fork, UT (US); Steven Joseph Parkinson, Clinton, UT (US)

(73) Assignee: Reflect Scientific Inc., Orem, UT (US)

( * ) Notice: Subject to any disclaimer, the term of this patent is extended or adjusted under 35 U.S.C. 154(b) by 0 days.

(21) Appl. No.: 16/528,511

(22) Filed: Jul. 31, 2019

(51) Int. Cl.

| | |
|---|---|
| ***F25D 21/04*** | (2006.01) |
| ***F25D 3/10*** | (2006.01) |
| ***F25B 19/00*** | (2006.01) |
| ***F25D 29/00*** | (2006.01) |

(52) U.S. Cl.
CPC ..... *F25D 21/04* (2013.01); *F25B 19/005* (2013.01); *F25D 3/10* (2013.01); *F25D 29/001* (2013.01); *F25D 29/006* (2013.01); *F25D 2201/10* (2013.01)

(58) Field of Classification Search
CPC ..... F25D 21/04; F25D 29/001; F25D 3/10; F25D 29/006; F25D 2201/10; F25B 19/005
See application file for complete search history.

(56) References Cited

U.S. PATENT DOCUMENTS 2,203,439 A * 6/1940 Oliver ..... F25D 31/003 62/229
2,284,905 A * 6/1942 Jackson ..... F25D 7/00 34/72
2,390,030 A * 11/1945 Paulson ..... C21D 1/63 312/405
2,426,525 A * 8/1947 Rundell ..... F25D 23/082 220/592.07
2,462,115 A * 2/1949 Luecke ..... F25D 19/00 62/448
2,464,606 A * 3/1949 Philipp ..... F25D 11/04 62/451
2,496,492 A * 2/1950 Prosek ..... F25D 19/02 62/449
2,607,204 A * 8/1952 Kleist ..... F25D 11/00 62/265
2,622,753 A * 12/1952 Philipp ..... F25D 11/04 220/4.01

(Continued)

FOREIGN PATENT DOCUMENTS

| | | |
|---|---|---|
| EP | 0024159 B1 | 11/1983 |
| EP | 1216389 B2 | 2/2014 |
| WO | 2012069954 A1 | 5/2012 |

*Primary Examiner* — Kun Kai Ma
(74) *Attorney, Agent, or Firm* — Tran & Associates

(57) ABSTRACT

The present invention is a high-performance ultra-low temperature chest freezer capable of reaching temperatures as low as −160° C. within several hours with the capability to automatically and continually defrost and dehumidify its payload bay before, during, and after a door open event without needing to cease freezing operations or raise the setpoint.

13 Claims, 16 Drawing Sheets

(56) References Cited

U.S. PATENT DOCUMENTS 2,756,570 A * 7/1956 Gale ..... F25D 31/007 62/331
3,094,164 A * 6/1963 Sherman ..... F25D 11/022 165/263
4,739,622 A * 4/1988 Smith ..... F25D 3/10 62/78
5,142,872 A * 9/1992 Tipton ..... F02G 1/0435 62/440
5,168,621 A * 12/1992 Kruck ..... B29D 99/001 29/451
5,182,924 A * 2/1993 Trulaske, Sr. ..... A47F 3/0443 62/255
5,398,520 A * 3/1995 Kamin ..... F25D 3/02 62/376
5,779,089 A * 7/1998 West ..... F17C 3/02 220/203.11
5,865,037 A * 2/1999 Bostic ..... B65D 81/2038 220/361
5,950,450 A * 9/1999 Meyer ..... C09K 5/066 62/457.9
6,044,648 A 4/2000 Rode
6,205,794 B1 * 3/2001 Brothers ..... F17C 3/10 62/457.9
6,332,325 B1 * 12/2001 Monfort ..... C21D 1/785 62/457.9
6,397,620 B1 6/2002 Kelly
6,631,625 B1 10/2003 Weng
6,863,123 B2 * 3/2005 Wang ..... F25D 3/10 165/263
6,990,819 B2 1/2006 Darling
7,621,148 B1 * 11/2009 Dain ..... F25D 23/063 220/592.01
8,371,169 B1 * 2/2013 Masyada ..... G01N 29/045 62/311
9,134,061 B2 9/2015 Bowdish
9,488,404 B2 11/2016 Smith
9,631,860 B2 * 4/2017 Gossens ..... A47F 3/0426
9,857,120 B2 1/2018 Bowdish
10,047,978 B1 8/2018 Moon
10,188,098 B2 1/2019 Moon
2004/0200231 A1 * 10/2004 Seiss ..... A47F 3/0408 62/246
2006/0053828 A1 * 3/2006 Shallman ..... F25D 3/14 62/457.9
2006/0225453 A1 * 10/2006 Martello ..... B60H 1/005 62/420
2007/0180849 A1 * 8/2007 Walker ..... F25D 11/006 62/441
2008/0268107 A1 * 10/2008 Chen ..... F25D 29/001 426/109
2010/0077775 A1 4/2010 Smith
2010/0120351 A1 5/2010 Morris
2013/0047658 A1 * 2/2013 Lennon ..... F25D 21/04 62/419
2015/0173526 A1 * 6/2015 Delgadillo ..... F25D 11/00 62/99
2017/0343247 A1 * 11/2017 Ahmad ..... F25B 9/04
2019/0133110 A1 5/2019 Moon
2019/0218029 A1 * 7/2019 Petz ..... B65F 1/14

* cited by examiner

HIGH PERFORMANCE ULT CHEST FREEZER WITH DEHUMIDIFICATION

FIELD OF INVENTION

The present invention relates to Ultra-Low Temperature (ULT) freezers, chest freezers, and the dehumidification and defrosting of such freezers.

PRIOR ART

There is great demand for freezers that can maintain temperatures as low as −160° C. whilst simultaneously giving the user increased safety, reliability, and control over the freezing process. Examples of uses for such freezers include: the freezing and storing of human blood-related components to −30° C.; the precise temperature control of pharmaceuticals at temperatures as low as −160° C.; and the proper and precise freezing of seafood to meet FDA regulations, which can require temperatures as low as −35° C. The proper functioning of such freezers is critical for several billion-dollar industries.

A common configuration for such freezers includes a tall frame with a door that swings open along a vertical axis, commonly referred to as an "upright freezer". An example of an upright freezer is shown in Figure One of U.S. Pat. No. 10,188,098, entitled "Extremely fast freezing, low-temperature blast freezer". U.S. Pat. No. 10,188,098 is hereby incorporated by reference. Such a configuration has the advantage of a greater interior volume to footprint ratio. Certain disadvantages exist, however, such as the pre-cooled internal air spilling out when the door is opened. This phenomenon occurs because the air within the freezer increases in density as it is cooled and, being of roughly the same composition of the ambient air, presumably, is heavier in a sense and drops. As there is no barrier to keep the heavier air within the freezer while the door is open, the air drops out. As air leaves the freezer, air must come in, and the only air available is the warmer ambient air, which then increases the temperature within the freezer and introduces a greater temperature gradient.

Another freezer configuration that solves this issue is commonly referred to as a "chest freezer" by those skilled in the art. A chest freezer is typically wider than it is deep or tall, as the word "chest" implies. An example of a chest freezer is shown in Figure One of U.S. Pat. No. 9,631,860 entitled "Chest freezer". Having a lid situated above the freezing compartment removes the possibility of cold, dense air spilling out of the freezer. U.S. Patent Application No. 20100120351 entitled "Frost reduction by air curtain" teaches an alternative method to solving the issue of air spilling out of upright freezers, namely "a catch basin at the bottom of the cabinet for collecting air, and a distribution channel fluidly connected to the catch basin, for recirculating the air collected from the catch basin to the top of the cabinet".

Typical freezers utilize cooling tubes wherein some form of coolant flows. U.S. Pat. No. 5,142,872 entitled "Laboratory freezer appliance" teaches "a number of tubes extending around the periphery of the reservoir which substantially evenly deliver the liquid argon refrigerant to heat transfer tubes which extend along either side of the freezer storage chamber in heat transfer communication therewith. The heat transfer tubes slope downwardly from the argon distributor such that the liquid argon flows along the tubes by gravity". Cooling tubes can be placed on all sides of the freezer interior, as shown in Figure Two of U.S. Pat. No. 7,621,148 entitled "Ultra-low temperature bio-sample storage system". U.S. Pat. No. 7,621,148 is hereby incorporated by reference. E.P. Patent No. 1,216,389 entitled "Refrigerator and/or freezer appliance" teaches "a cooling means associated with the lid and adapted to cool the interior but not the exterior of the container".

A common type of freezer is known to those skilled in the art as a "mechanical freezer", referring to its method of cooling. Such cooling is achieved by a refrigerant that is compressed by a compressor, cooled at the higher pressure, and then rapidly decompressed. Such decompression causes a drop in temperature, per the Ideal Gas Law. Thermal energy is then removed from the freezer by the refrigerant which is then recycled back to the compressor. An example of such a freezer is taught in U.S. Pat. No. 6,631,625 entitled "Non-HCFC refrigerant mixture for an ultra-low temperature refrigeration system".

Another type of freezer utilizes a cryogenic fluid, such as liquid nitrogen, to cool the freezer. A freezer of this type is taught in the aforementioned U.S. Pat. No. 10,188,098. The natural pressure of stored liquid nitrogen forces said nitrogen through cooling tubes to cool the freezer. An alternative method to use a cryogenic fluid is taught in U.S. Pat. No. 6,044,648 entitled "Cooling device having liquid refrigerant injection ring" and E.P. Patent No. 0,024,159 entitled "Cryogenic freezer". The alternative method taught in these patents, known as "direct injection" by those skilled in the art, is to inject liquid nitrogen directly onto the items to be cooled, whether in a tunnel or in an enclosed container. Direct injection can cause extreme temperature gradients and is much more difficult to precisely control temperature with.

Insulation in such freezers are important for reducing heat gain and thus increasing efficiency and efficacy. U.S. Pat. No. 6,397,620 entitled "Ultra-low temperature freezer cabinet utilizing vacuum insulated panels" teaches that Vacuum Insulated Panels (VIPs) can be used to significantly reduce heat gain. U.S. Pat. No. 5,865,037 entitled "Insulated chest and method" also teaches that insulation can be used, although this insulation is a vacuum that is created through excavating air through conduits in the lid. The aforementioned U.S. Pat. No. 10,188,098 also teaches various forms of insulation.

Perhaps the greatest concern users of such freezers have is that of humidity and frost. The freezing point of water at pressures we are accustomed to and most often experience is close to 0° C. As the colloquial term "freezer" points out, such devices operate at temperatures below 0° C., and provide an environment which enables the solidification of water. At operating temperatures as low as −160° C., ULT freezers can rapidly accumulate frost. The internal surfaces of such freezers are of such temperatures as to practically instantaneously freeze water particles in the air that come into contact with them. This phenomenon accumulates frost and eventually ice as such freezers are opened and closed, some several times per day. This build-up of frost and ice can cause serious issues and greatly hamper typical operation.

W.O. Patent No. 2012069954 entitled "Ult freezer with reduced ice formation" teaches a means to reduce such problems, namely "a top compartment which contains an evaporator unit for a refrigerating circuit of the freezer, the evaporator unit being provided with electric heating elements for performing defrosting and heat insulation being provided between top compartment and cell, the top compartment being connected at the rear and at the front to the two ends of a circuit for circulating air around the cell".

The aforementioned E.P. Patent No. 1216489, alternatively, teaches that the external surfaces of a freezer always remain at ambient temperature so as never to experience frost buildup. Drawers have individual cooling means which are covered by a screen when the drawers are opened, thus reducing frost building on the cooling means. The only surface capable of frost buildup are the internal surfaces of the drawers themselves.

The air that enters a freezer after it is opened is typically at a higher humidity than the air within the freezer, due to the accumulation of the moisture onto cold surfaces as frost. One method to reduce frost build-up is to reduce the humidity of the air within a freezer by circulating the air within a freezer with a dehumidifier composed of materials such as a moisture sponge, or a desiccant. Such freezers are taught in U.S. Pat. No. 6,990,819 entitled "Dryer system for the prevention of frost in an ultra low temperature freezer", U.S. Patent Application No. 20100077775 entitled "Frost reduction by active circulation", and U.S. Pat. No. 9,488,404 entitled "Frost reduction by active circulation".

Air densities as it is reduced in temperature, or in other words reduces its volume as it grows colder. This causes problems for ULT freezers, as when air within the freezer shrinks it creates a vacuum. This can damage freezer components as well as lead to air leakage from without the freezer. The aforementioned patents U.S. Patent Application No. 20100077775, U.S. Pat. Nos. 9,488,404, and 6,397,620 teach that an equalizing port can be used to allow air to enter the freezer to equalize the pressure. This enables additional moisture to enter the freezer, so the aforementioned patents U.S. Patent Application No. 20100077775 and U.S. Pat. No. 9,488,404 teach that the equalizing port can lead to a dehumidification means prior to entering the freezer to reduce moisture content entering the freezer. Additionally, the aforementioned U.S. Pat. No. 7,621,148 teaches that over-pressurizing the freezer can be used to reduce humid air entering the freezer. U.S. Pat. No. 9,857,120 entitled "System and methods for improvements to a ultra-low temperature bio-sample storage system" furthermore teaches that a desiccator can be used to desiccate the air used to create the over-pressurization immediately before and after an open-door event. U.S. Pat. No. 9,857,120 is hereby incorporated by reference.

U.S. patent application Ser. No. 16/112,658, U.S. Pat. Nos. 10,047,978, 9,134,061, and 7,621,148 are commonly owned, the contents of which are hereby incorporated by reference.

While some methods have been taught as to have freezers capable of temperatures as low as −160° C. whilst maintaining low frost build-up, in practice there is still a great need to develop methods to reduce frost build-up.

SUMMARY

The present system is a high performance, ultra-low temperature chest freezer capable of significantly improved temperature homogeneity with greatly enhanced dehumidification means. It consists of a payload bay with rigid sides and bottom, a lid, an evaporator housing attached to the underside of the lid with one or more evaporators within it that are directly exposed to the payload bay atmosphere when the lid is closed, one or more coolant tubes linked in parallel and thermally coupled to the one or more evaporators, a liquid nitrogen inlet on one end of the one or more coolant tubes, an exhaust outlet on the end opposite that of the end that the liquid nitrogen inlet is attached to, one or more cryogenic solenoid valves to control the flow of liquid nitrogen through the one or more coolant tubes, one or more over-pressurization relief valves coupling the payload bay atmosphere to the exhaust outlet so as to allow flow only in the direction away from the payload bay, and one or more purge inlet valves coupling the one or more coolant tubes to the payload bay atmosphere so as to allow only gaseous nitrogen to flow towards the payload bay atmosphere.

One embodiment utilizes the natural phenomenon of density to have extreme temperature homogeneity within the payload bay. As explained previously, gaseous substances increase in volume as they grow warmer and decrease in volume as they grow colder. This increase in volume is accompanied by a decrease in density and the decrease in volume is accompanied by an increase in density. Per the law of buoyancy, fluids with greater densities will sink below fluids of lesser densities. One embodiment has one or more evaporators located within the evaporator housing that are directly exposed to the payload bay atmosphere, to enable greater freezing capability. This also marks it distinctly different from prior art, wherein the conduits in the lid were used exclusively to create a vacuum in the lid and not as a means of cooling. The one or more evaporators within the evaporator housing of one embodiment of the present invention are the means by which the atmosphere within the payload bay is cooled. Extremely cold liquid or gaseous nitrogen flows through the one or more coolant tubes, typically close to the boiling point of liquid nitrogen, −196° C. Heat transfer occurs wherever there is a temperature gradient, which exists between the nitrogen and the payload bay atmosphere in one embodiment. The one or more evaporators within the evaporator housing cool the air in contact with them, which in turn becomes cooler, and thus denser, than the rest of the air in the payload bay, or in other words, with the air below it. This colder, denser air then drops to the bottom of the payload bay, leaving a vacuum in its place. Warmer, less dense air naturally rises to fill up the vacuum next to the one or more evaporators. This air in turn cools and drops to the bottom of the payload bay where the previously cooled air has now gained thermal energy and begins to rise. This natural cycling causes air flow within the payload bay which result in faster cooling as well as much tighter temperature homogeneity within the payload bay. This is markedly different and considerably more effective than prior art which teaches cooling coils can be in the walls or within drawers.

Cold air dropping onto a flat surface greatly hampers the natural cyclic motion of air flow within an enclosed environment. One embodiment has one or more coolant tubes coupled to one or more evaporators within the lid. When the lid is closed, the evaporators are directly exposed to the environment within the payload bay. Typically, those skilled in the art recognize that lids to chest freezers are smooth or perhaps patterned aesthetically. One embodiment has significant open space that allow for the direct exposure of the one or more evaporators to the atmosphere of the payload bay. Several methods could be used to balance aesthetics with functionality, some of which are explained. The present invention should not be limited to these methods, which are used to explain to those skilled in the art the scope of the invention. Plain sheet metal with holes of varying shapes can be used, as can screens of varying materials. More intricate methods can include having two or more layers whose openings are staggered so as not to reveal the one or more evaporators but still keep them directly exposed to the atmosphere of the payload bay. Furthermore, these layers can be angled so as to allow easier flow of naturally dropping fluids. Fluids pool on flat surfaces whereas they fall on sloped surfaces, such as a roof. One embodiment has significant exposed area to allow for increased atmospheric coupling between the one or more evaporators and the payload bay.

Airborne moisture has been explained to be a significant problem for freezers. A significant accumulation of moisture occurs during a door-open event. One embodiment over-pressurizes the atmosphere of the payload bay immediately prior to a door-open event. This is accomplished by opening the one or more purge inlet valves. Liquid nitrogen flows into the liquid nitrogen inlet and through the one or more coolant tubes. As the liquid nitrogen flows through the coolant tubes, thermal energy is transferred from the atmosphere of the payload bay to the evaporators and into the coolant tubes. Once enough thermal energy has been transferred to the liquid nitrogen, it phase-changes to gaseous nitrogen. The gaseous nitrogen is then directed to the exhaust outlet as waste. The one or more purge inlet valves can be controlled in such a way as to allow gaseous nitrogen flow into the payload bay. This method enables the over-pressurization of the payload bay, which causes airflow from the payload bay into the ambient air at the beginning of a door-open event, instead of moist airflow into the payload bay.

Air naturally mixes, due to temperature, pressure, and chemical gradients amongst other things. Humidity can enter the payload bay during a door-open event because of this as well as when products are placed within the freezer, when products are taken out of the freezer, and when the moist exhalation of freezer operators are directed within the freezer. This humidity is problematic because it increases the frost accumulation rate, as explained previously. It can also cause fog to accumulate within the payload bay. Low temperatures can cause the water vapor in air to condensate within the payload bay, creating fog which can be hard to see through. One embodiment can reduce the humidity within the payload bay during a door-open event by continuously allowing a stream of gaseous nitrogen to enter the payload bay through the one or more purge inlet valves. Nitrogen in its pure form is a "dry" gas, that is to say that it does not inherently have moisture. For example, nitrogen makes up roughly 75% of the ambient air on Earth regardless of the humidity level. As the gaseous nitrogen enters the payload bay, it is typically colder than the air already in the payload bay and thus displaces the air already within the payload bay upward. This causes a slight spilling of the air from the payload bay without increasing the temperature within the payload bay. It also makes it so that humidity entering the payload bay is constantly being displaced upward as well, preventing frost accumulation as well as fog accumulation. This steady exhausting of gaseous nitrogen into the payload bay renders the embodiment distinct from conventional system. Furthermore, the system is increasingly distinct from prior art in that it uses the gaseous nitrogen derived from the freezing cooling process rather than a dehumidifying unit.

As previously explained, air becomes denser as it is colder. Freezers are typically air-tight in a general sense and experience a large pressure drop within as the air within them shrink as it gets colder. This pressure drop can cause structural damage to the freezer because of the forces involved with pressure gradients. It can also cause normally air-tight freezers to develop micro-channels wherein air from without the freezer can enter within the freezer, bringing with it the ambient humidity. One embodiment over-pressurizes the payload with methods previously discussed while the lid is shut and the air within it shrinks. In summary, gaseous nitrogen from the cooling system is used to over-pressurize the payload bay. This over-pressurization prevents any ambient air to enter the freezer with its humidity. This is distinctly different from prior art where pressure equalizing ports are used. Furthermore, the gaseous nitrogen used to over-pressurize the payload bay is completely dry, and is much more effective than prior art methods which use dehumidifiers and desiccants to remove moisture from the air to enter the freezer, or even circulating the air within the freezer.

Frost accumulation is a serious concern for freezers and is actively reduced by one embodiment. Sublimation is a process where a solid phase changes directly to a gas, rather than the normal phase change to liquid and then to gas, or melting and then evaporation. Sublimation can occur for water ice at temperatures below its freezing point, typically around 0° C. A direct example of this is when ice in common household freezers appears to shrink within an enclosed freezer without melting first. Sublimation for water ice can occur within an atmosphere that is sufficiently dry, even if the temperature is increasingly below zero. Vapor pressure is defined as the pressure of a gas onto its solid form. When more than one vapor is present (as is the case in almost all circumstances) the vapor pressures of each component are called partial pressures. Any solid or liquid will evaporate or sublimate so long as the ambient atmosphere is below their individual partial pressures. In other words, ice will sublimate within an enclosed environment until the partial pressure corresponding to it reaches its equilibrium. Typically, the partial pressure equilibrium decreases in pressure as the temperature of the solid or gas is decreased. One embodiment utilizes this phenomenon to defrost all freezer components in contact with the payload bay atmosphere. This is accomplished by allowing gaseous nitrogen to enter the payload bay through the one or more purge inlet valves whilst allowing the atmosphere within the payload bay to exit through the one or more over-pressurization relief valves. This create airflow within the payload bay. The air within the payload bay will naturally attempt to diffuse all of its individual components, including moisture. This will result in moisture leaving the atmosphere of the payload bay, making it drier within the payload bay, or in other words, decreasing the instantaneous partial pressure of water vapor within the payload bay. This in turn will result in increased sublimation by any solid water ice in contact with the payload bay atmosphere, or in other words will de-frost the interior of the payload bay. The continual airflow will result in a constantly diminishing water vapor partial pressure and allow for constant and indefinite defrosting. The "injection" of gaseous nitrogen into the payload bay differs from conventional system that uses direct injection because the injection is specifically for the purpose of dehumidifying and defrosting and not for temperature reduction. While the dehumidification process can be strategically implemented to increase convection and thus cooling capability, its main purpose is to defrost the freezer.

Advantages of the system may include one or more of the following. The system provides increased temperature homogeneity within the payload bay; decreased moisture influx before, during, and after a door-open event; and continual self-defrosting capabilities.

DESCRIPTION

A detailed description of embodiments of the present invention is provided herein. It is to be understood, however, that the present invention may be embodied in various forms. Therefore, specific details disclosed herein are not to be interpreted as limiting, but rather as a basis for the claims and as a representative basis for teaching one skilled in the art how to employ the present invention in virtually any appropriately detailed system.

Figure 1:
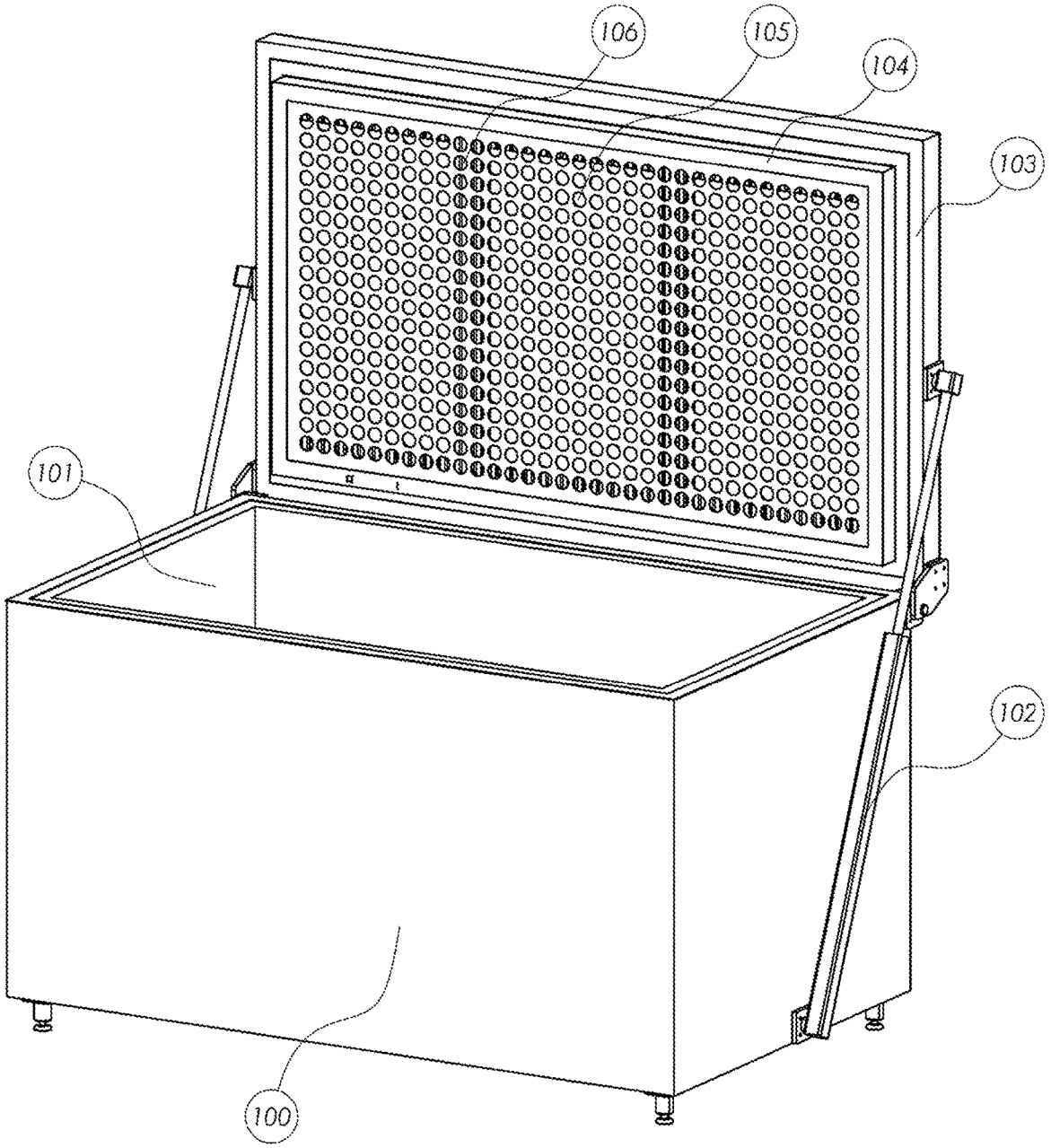
FIG. 1 is an exemplary perspective view of one embodiment of the present invention with one possible iteration of the evaporator housing.
Figure 2:
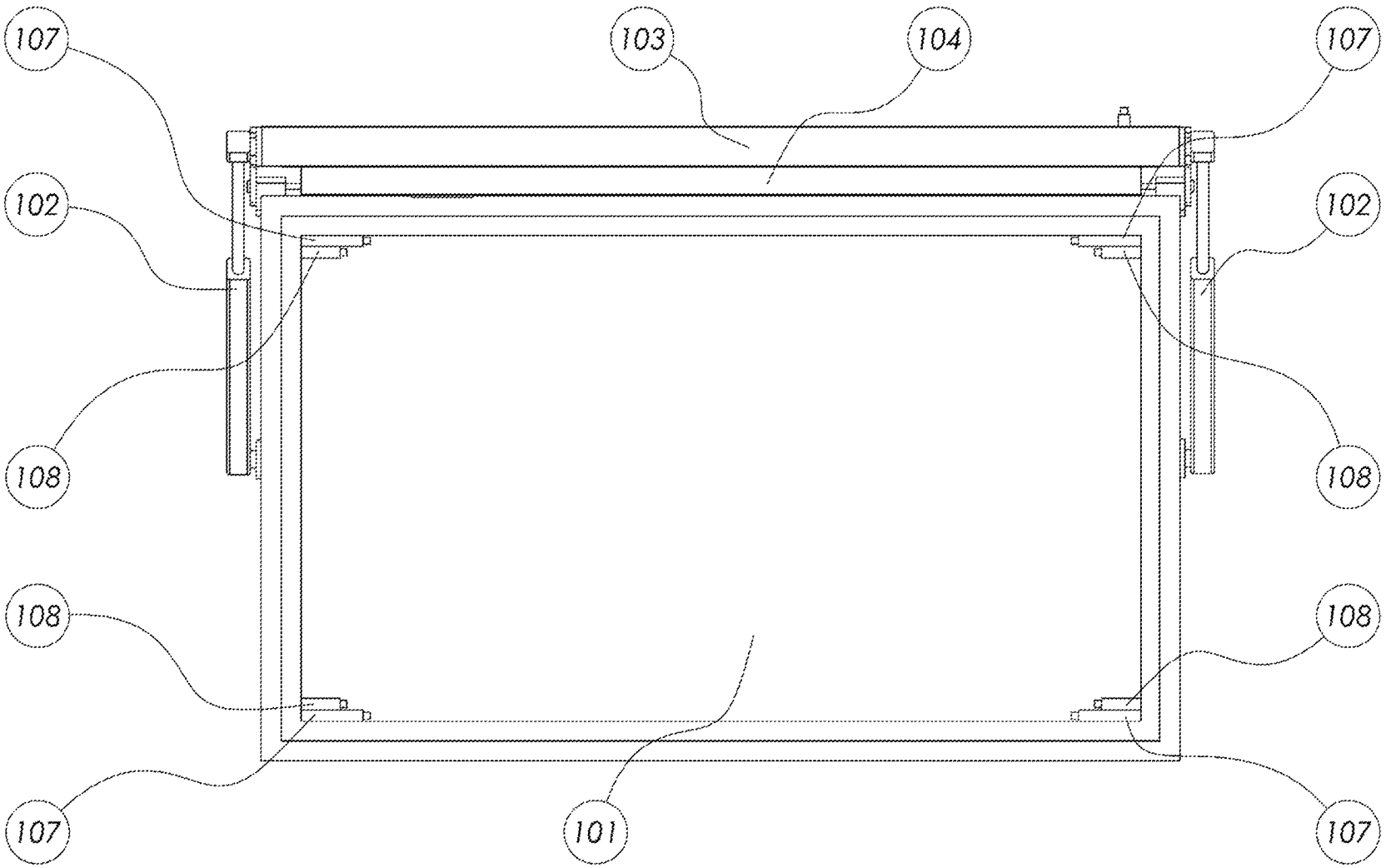
FIG. 2 is an exemplary top view of one embodiment of the present invention demonstrating the one or more purge inlet valves and one or more over-pressurization relief valves.
Figure 3:
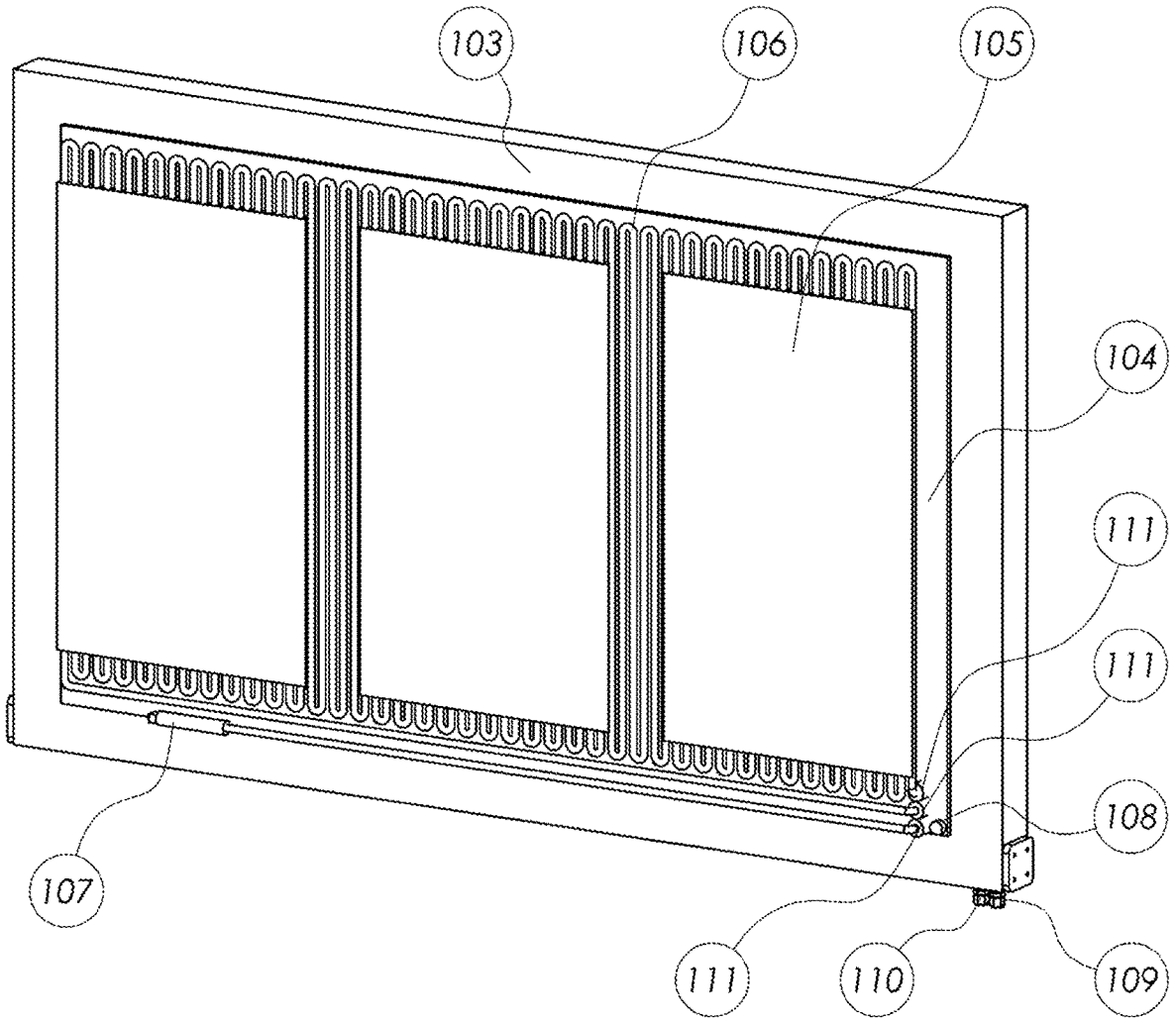
FIG. 3 is an exemplary perspective cutaway view of the lid to demonstrate the one or more evaporators and the one or more coolant tubes.

Referring to FIGS. 1-3, a high-performance ultra-low temperature chest freezer 100 is composed of a payload bay 101, one or more linear actuators 102, and a lid 103. An evaporator housing 104 is attached to the lid 103 in such a way as to cover the majority of the surface area above the payload bay 101 when the lid 103 is closed. Within the evaporator housing 104 are one or more evaporators 105. One or more coolant tubes 106 are thermally coupled to the one or more evaporators 105. The evaporator housing 104 is designed such that the one or more evaporators 105 are atmospherically coupled to the payload bay 101. A liquid nitrogen inlet 109 is coupled to the one or more coolant tubes 106 and can attach to a liquid nitrogen source. An exhaust outlet 110 is coupled to the one or more coolant tubes 106 in such a way as to cause liquid nitrogen to flow from the liquid nitrogen inlet 109, through the one or more coolant tubes 106 and out the exhaust outlet 110. One or more cryogenic solenoid valves 111 control the flow of liquid nitrogen within the one or more coolant tubes 106. The liquid nitrogen phase changes to gaseous nitrogen within the one or more coolant tubes 106 as they absorb thermal energy. One or more purge inlet valves 107 are coupled to the one or more coolant tubes 106 in such a way as to allow gaseous nitrogen to exit the one or more coolant tubes 106 and enter the payload bay 101 through the one or more purge inlet valves 107. One or more over-pressurization relief valves 108 are coupled to the one or more coolant tubes 106 in such a way as to only allow flow from the payload bay 101 to the exhaust outlet 110 without any possibility of flow coming the opposite way. The one or more linear actuators 102 lift the lid 103.

Figure 4:
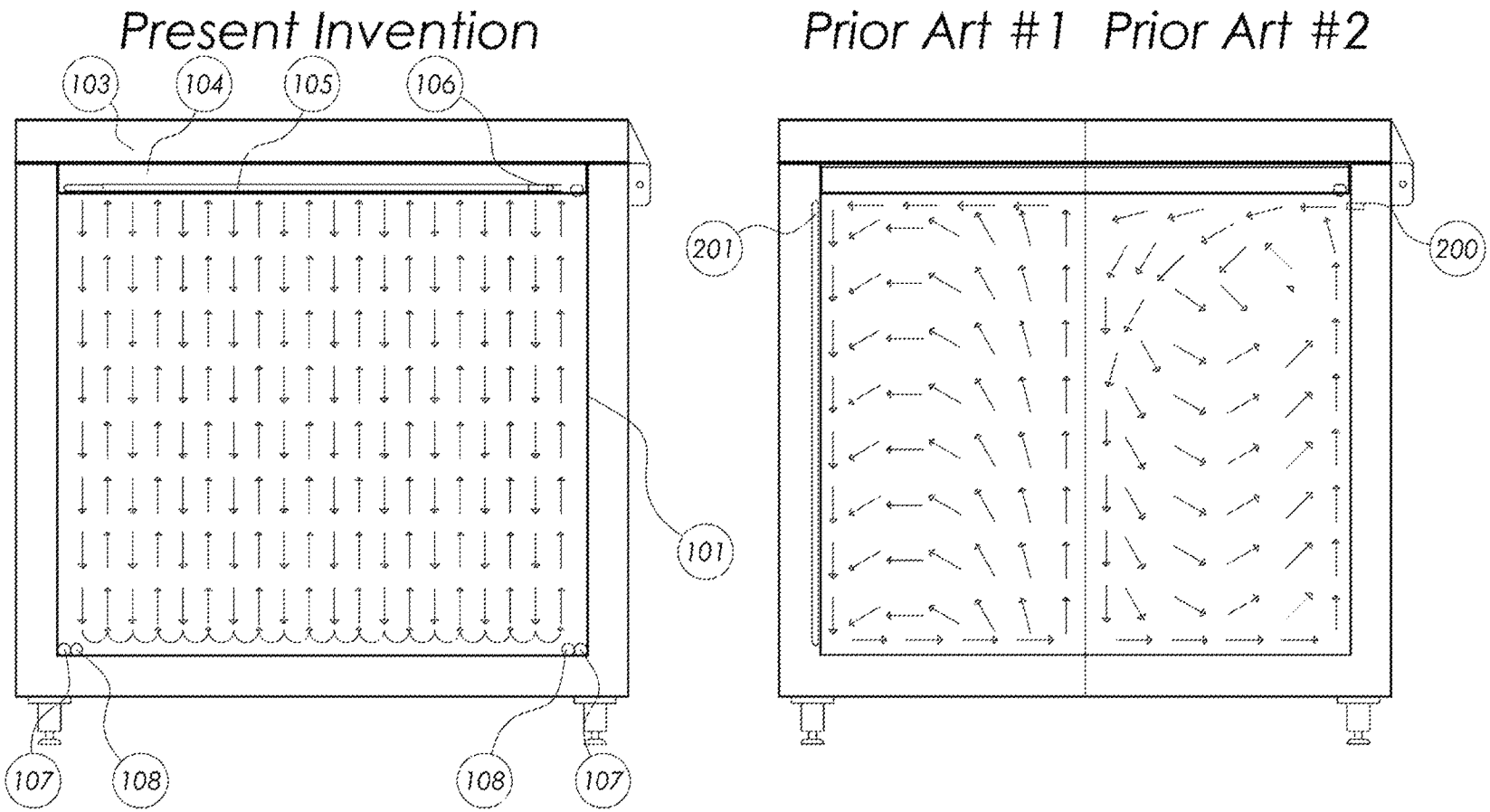
FIG. 4 is an exemplary section view of the payload bay of one embodiment of the present invention demonstrating the airflow within the payload bay compared to prior art.

Now referring to FIG. 4, one embodiment is composed of the payload bay 101, the lid 103, the evaporator housing 104, the one or more coolant tubes 106, the one or more evaporators 105, the one or more purge inlet valves 107, and the one or more over-pressurization relief valves 108. One embodiment is the high-performance ultra-low temperature chest freezer 100 from FIGS. 1-3 and operates as such. Two forms of prior art chest freezers are considered, one with a heat exchanger 201 arranged vertically on the first prior art payload bay 202 and another with an air circulator 200 that circulates chilled air through the second prior art payload bay 203.

The cooling means, or the one or more evaporators 105, are directly above the payload bay 101 of one embodiment of the present invention. As the air within the payload bay 101 is cooled, the individual particles of air lose some of their kinetic energy. This cooling occurs as thermal energy is transferred across the temperature gradient of the warmer air of the payload bay 101 and the colder one or more evaporators 105. In other words, air is cooled as it comes into contact with the one or more evaporators 105. Air particles with lower kinetic energies drop beneath similar air particles with higher kinetic energies because they cannot resist the gravitational force acting on them as much as the air particles with higher kinetic energies. This results in cold air dropping from around the one or more evaporators 105 to the bottom of the payload bay 101. Warmer air, or air with relatively greater kinetic energies, will rise above the colder air, or air with relatively lesser kinetic energies. As the one or more evaporators 105 cover a significant portion of the surface area of the top of the payload bay 101, cold air drops across the entire top face of the payload bay 101. This doesn't allow for specific channels of warmer air to rise within the payload bay 101 to the one or more evaporators 105. Thus, there is homogeneity in the temperature throughout the payload bay 101 if one were to sample temperatures throughout a horizontal slice of the atmosphere within the payload bay 101. This results in complete mixing and extremely even cooling of the payload bay.

In contrast, referring to prior art #1 of FIG. 4, when the cooling means, or the heat exchanger 201, is placed within the walls of the first prior art payload bay 202, heat transfer occurs from the air within the first prior art payload bay 202 immediately adjacent to the walls and in no other location. This results in cold air falling only along the walls of the first prior art payload bay 202. This cold air will pool along the bottom of the first prior art payload bay 202. Warmer air will rise within all available volume not already taken up by falling cold air, which is the bulk of the area of first prior art payload bay 202 not immediately adjacent to a wall. This causes a cyclic action of dropping along a wall and rising in the middle. This does not lead to even temperatures as the individual air particles even their kinetic energies out over time as they collide with each other, or in other words the cold air warms up as it goes throughout the cycle. Modest temperature homogeneity is the best typical prior art using this method can expect.

Furthermore, referring to prior art #2 of FIG. 4, when the cooling means, or the air circulator 200, expels cold air within the second prior art payload bay 203, a similar cyclic action occurs except the cold air drops away from the air circulator 200 and rises away from it, depending on the configuration. Regardless, unless intricate configurations are used, this method can only provide modest temperature homogeneity at best.

Comparing the present system to prior art #1 and prior art #2, the present system is capable of much tighter and more even temperature homogeneity.

Figure 5:
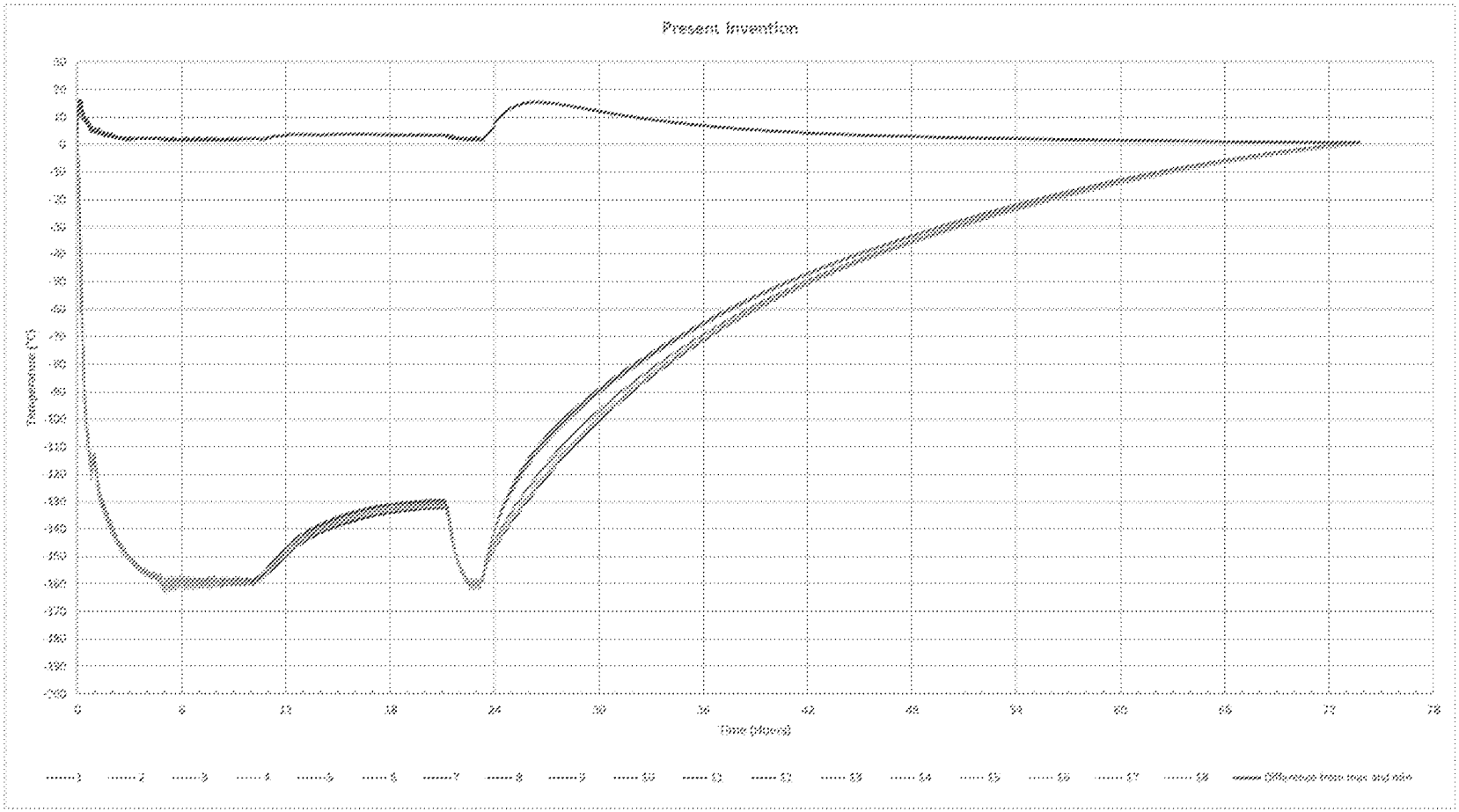
FIG. 5 is a chart showing the actual temperature profile of one embodiment of the present invention.
Figure 6:
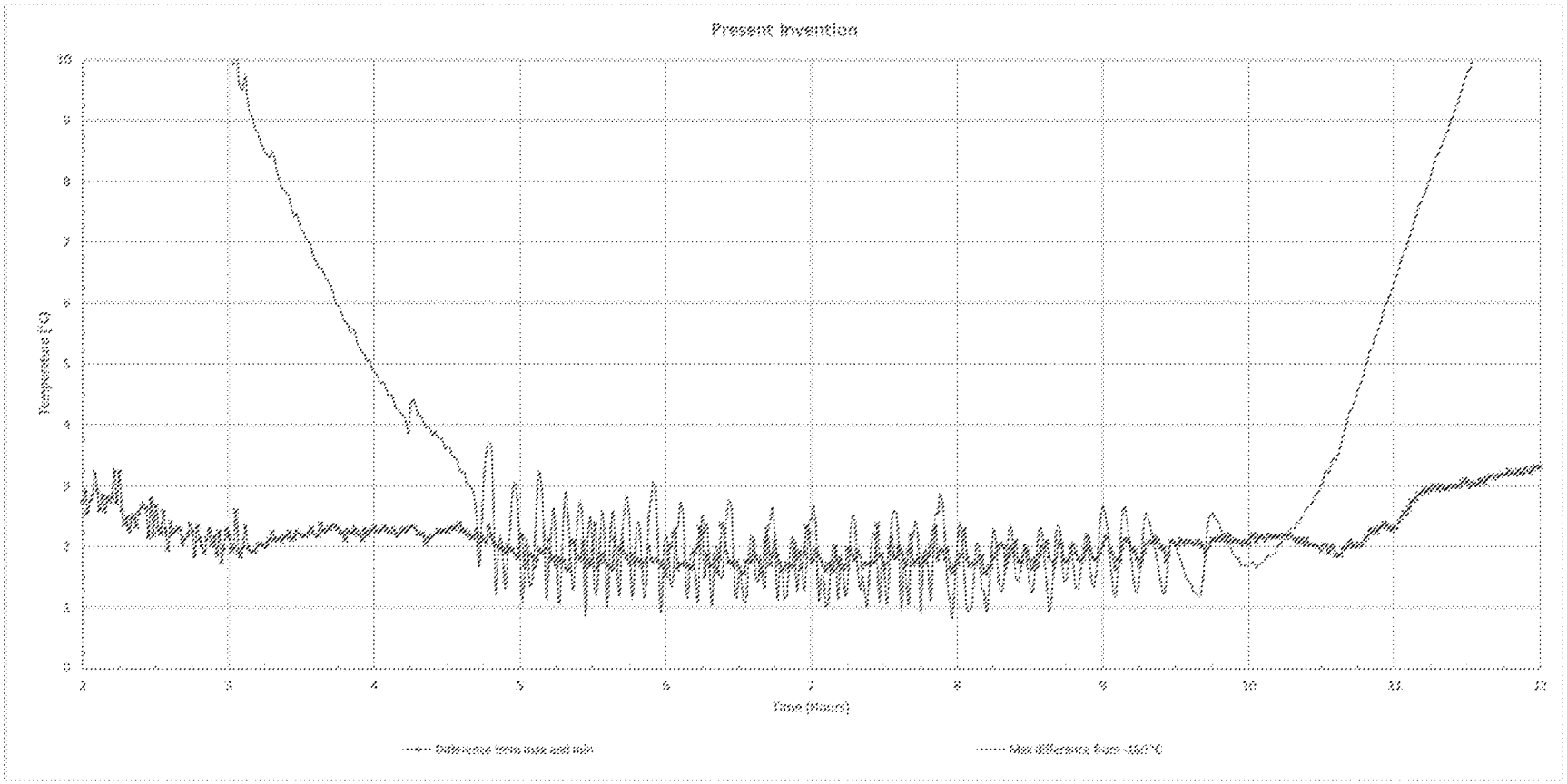
FIG. 6 is a chart showing a detailed portion of the actual temperature profile of one embodiment of the present invention, highlighting its temperature homogeneity.

Now referring to FIGS. 5-6, the actual temperature profile of one embodiment of the present invention is shown. Eighteen thermocouples were placed within the payload bay equally spaced out from each other and their temperatures shown. The difference between the warmest and coldest thermocouple at each datapoint is also shown.

One embodiment reached −120° C. in approximately one hour. During the test, the liquid nitrogen supply was switched to a lower pressure at around the one-hour mark. This was done because small Dewar's were used as the liquid nitrogen source and one had run out, requiring a switch. This second Dewar was at a substantially lower pressure which resulted in a slower cooling rate. Had the embodiment continued to utilize the higher pressure, it would have reached −160° C. in approximately two hours.

One embodiment was held at −160° C. for approximately five hours, during which the greatest temperature difference between internal thermocouples was just over 2° C. and the greatest difference from −160° C. any individual thermocouple showed was just over 3° C. At times, the greatest difference from −160° C. any individual thermocouple showed was below 1° C. while simultaneously the greatest temperature difference between internal thermocouples was under 2° C. Those familiar with the art of ULT freezers know that the cooling means of an ULT freezer is turned on and off cyclically, maintaining a temperature within a few degrees of the setpoint. As an ULT freezer's cooling cycle turns off, cold air drops to the bottom of the ULT freezer because there is nothing mixing it. It is because of this cold air dropping that the embodiment had temperature differences larger than the minimum. This shows that the embodiment is capable of extremely tight temperature tolerances and temperature homogeneity. Greater variation in the testing data is due to the cyclic cooling those skilled in the art of chest freezers would recognize.

It is notable that the above system held impressive temperature homogeneity during warm-up, between the twelve-hour mark and the eighteen-hour mark.

Figure 7:
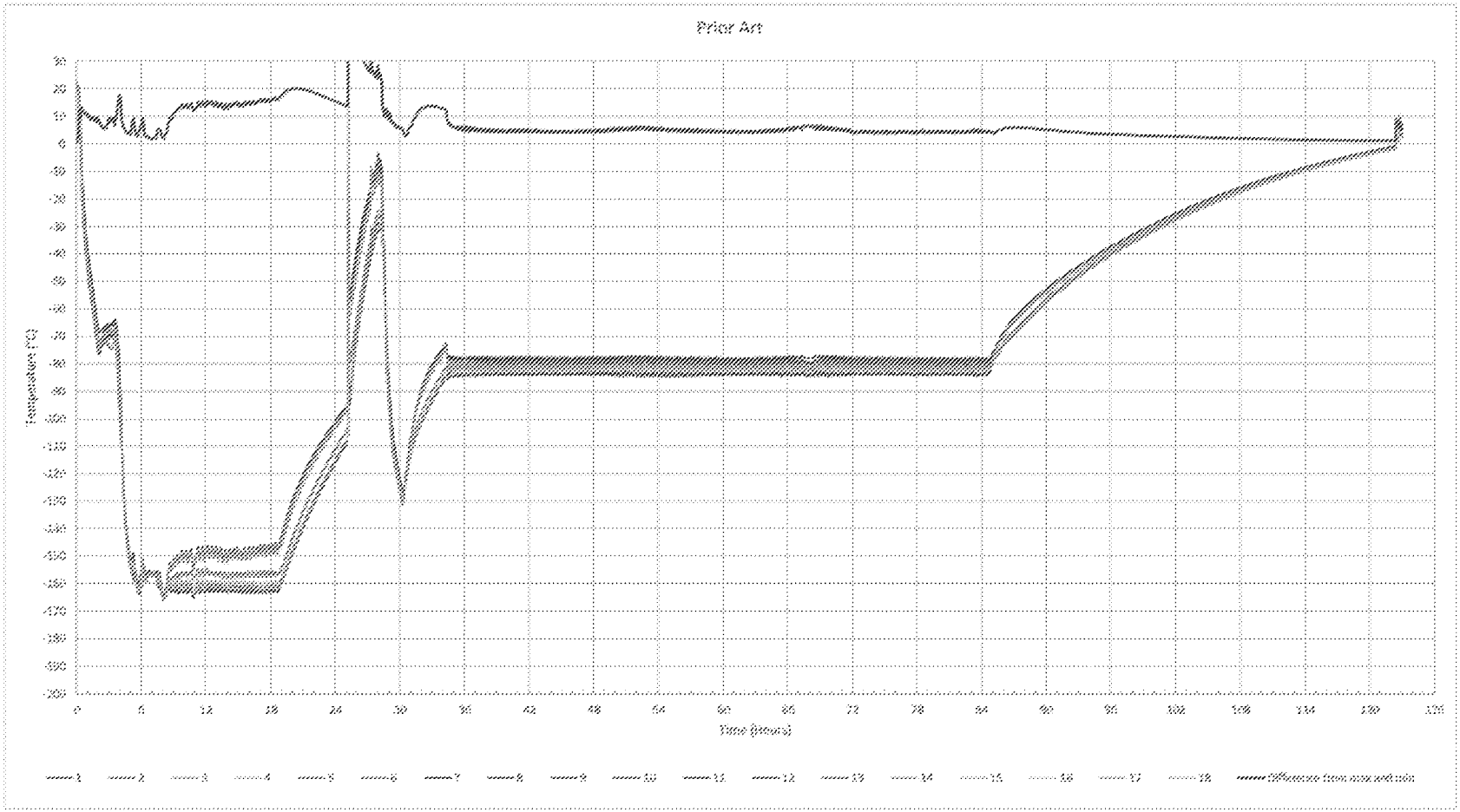
FIG. 7 is a chart showing the actual temperature profile of a prior art chest freezer.
Figure 8:
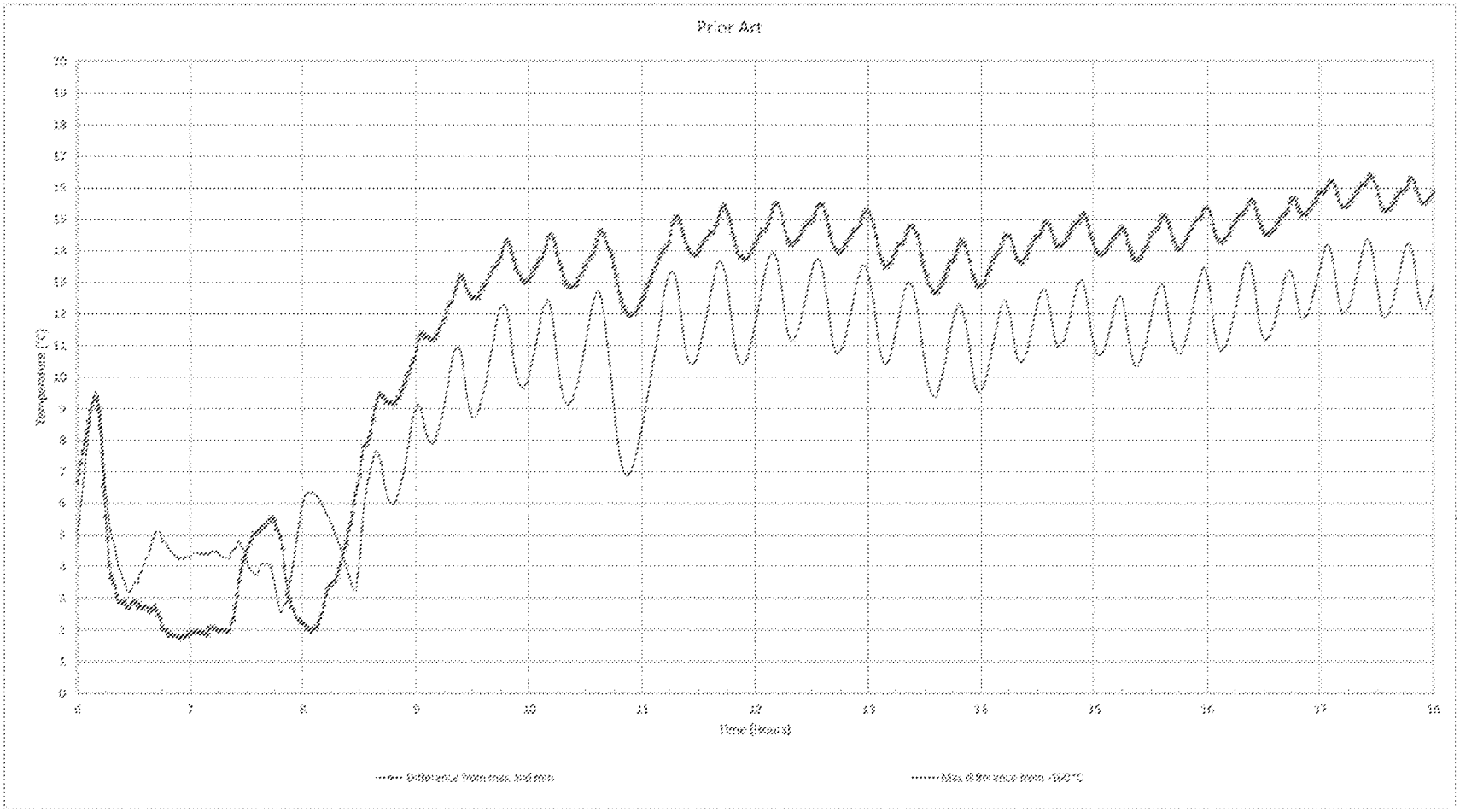
FIG. 8 is a chart showing a detailed portion of the actual temperature profile of a prior art chest freezer, highlighting its temperature homogeneity.
Figure 9:
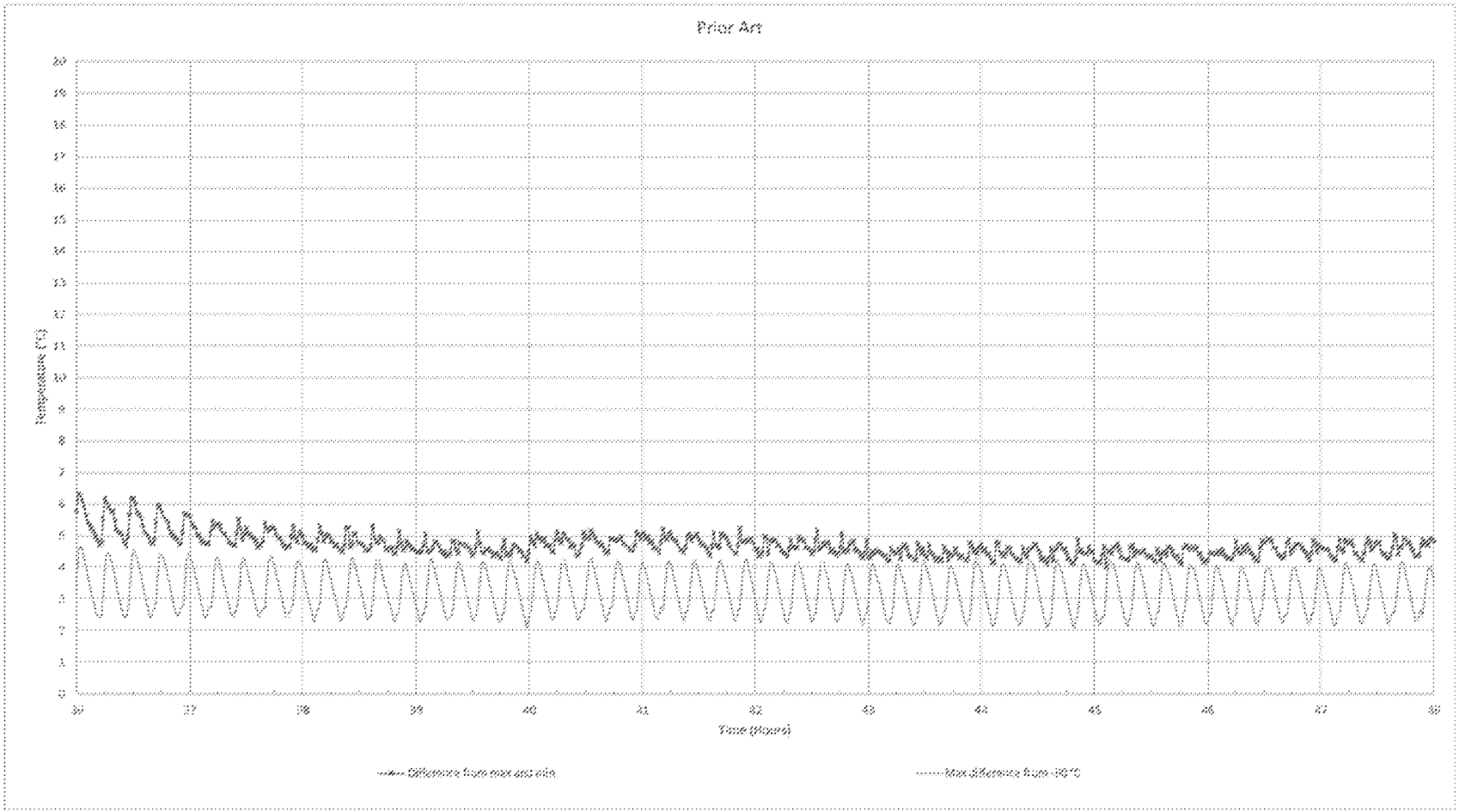
FIG. 9 is a chart showing a detailed portion of the actual temperature profile of a prior art chest freezer, highlighting its temperature homogeneity at a different setpoint than that of FIG. 8.

Now referring to FIGS. 7-9, the actual temperature profile of a prior art chest freezer is shown. The prior art chest freezer utilized cooling tubes within its side walls. Eighteen thermocouples were placed within the payload bay equally spaced out from each other and their temperatures are shown. The difference between the warmest and coldest thermocouple at each datapoint is also shown.

One embodiment was used to cool down the prior art chest freezer up until the eight-hour mark. This was done in order to rapidly cool down the prior art chest freezer to save time. Prior art was used in the prior art chest freezer after the eight-hour mark. The prior art chest freezer was held at −160° C. for approximately nine hours, during which the greatest temperature difference between internal thermocouples was over 15° C. and the greatest difference from −160° C. any individual thermocouple showed was around 14° C. At times, the greatest difference between internal thermocouples was approximately 12° C. with a corresponding 7° C. for the greatest difference from −160° C. for the thermocouples. Comparing this with the embodiment from FIGS. 5-6, the system was approximately seven times more precise and uniform over conventional chest freezer.

Additionally, the prior art chest freezer was held at −80° C. for over ten hours, during which the greatest temperature difference between internal thermocouples was around 5° C. and the greatest difference from −80° C. any individual thermocouple showed was just over 4° C. At its best, the prior art chest freezer had a temperature difference between internal thermocouples just over 4° C. and a difference from −80° C. at just over 2° C. during this time. Again, comparing this data with the data from the embodiment of FIGS. 5-6, the design was over twice as precise and uniform when compared to the conventional chest freezer, despite the higher temperature of the prior art chest freezer. Tighter temperature homogeneity and uniformness should have occurred at the warmer temperature. This demonstrates the great capability of one embodiment of the present invention.

Figure 10:
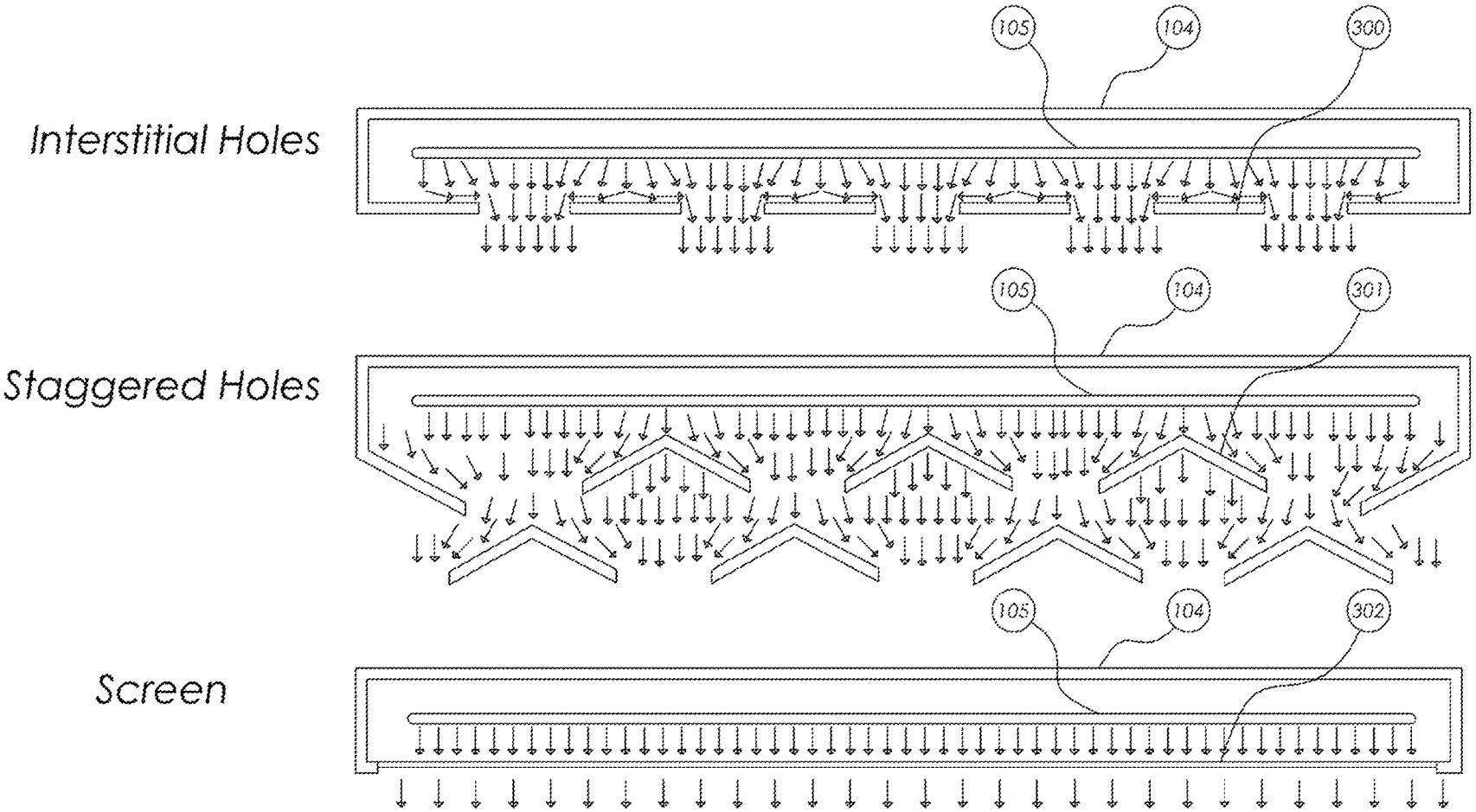
FIG. 10 has several exemplary section views of the evaporator housing using different methods of being atmospherically coupled to the payload bay.

Now referring to FIG. 10, the evaporator housing 104 encloses the one or more evaporators 105 with a method of atmospherically coupling the atmosphere within the evaporator housing 104 with the atmosphere beneath it. The methods include, but are not limited to, one or more interstitial holes 300, one or more staggered holes 301, and a screen 302.

As previously discussed, colder air drops when compared to warmer air. When one or more interstitial holes 300 are placed on the bottom of the evaporator housing 104, cold air is allowed to fall through them. Cold air will bunch up on the spaces around the one or more interstitial holes 300, which can reduce the air flow. When one or more staggered holes 301 are placed on the bottom of the evaporator housing 104 such that the one or more evaporators 105 within the evaporator housing 104 cannot be seen, cold air falls within the one or more staggered holes 301. Additionally, when the area around the one or more staggered holes 301 is slanted, as shown in FIG. 10, air is allowed to drop more readily with the assistance of gravity. When the screen 302 is placed on the bottom of the evaporator housing 104, cold air is allowed to fall through it, but the screen 302 hampers the air flow slightly.

With the one or more interstitial holes 300, it can be seen that the air flow is significantly hampered by the flat portions. In other words, the arrows simulating airflow are significantly turned from pointing downward. With the one or more staggered holes 301, it can be seen that the slanted area between the one or more staggered holes 301 hampers airflow, but not as much as with the one or more interstitial holes 300. The screen 302 doesn't alter the directionality of the airflow whatsoever, but it does reduce the airflow slightly.

Figure 11:
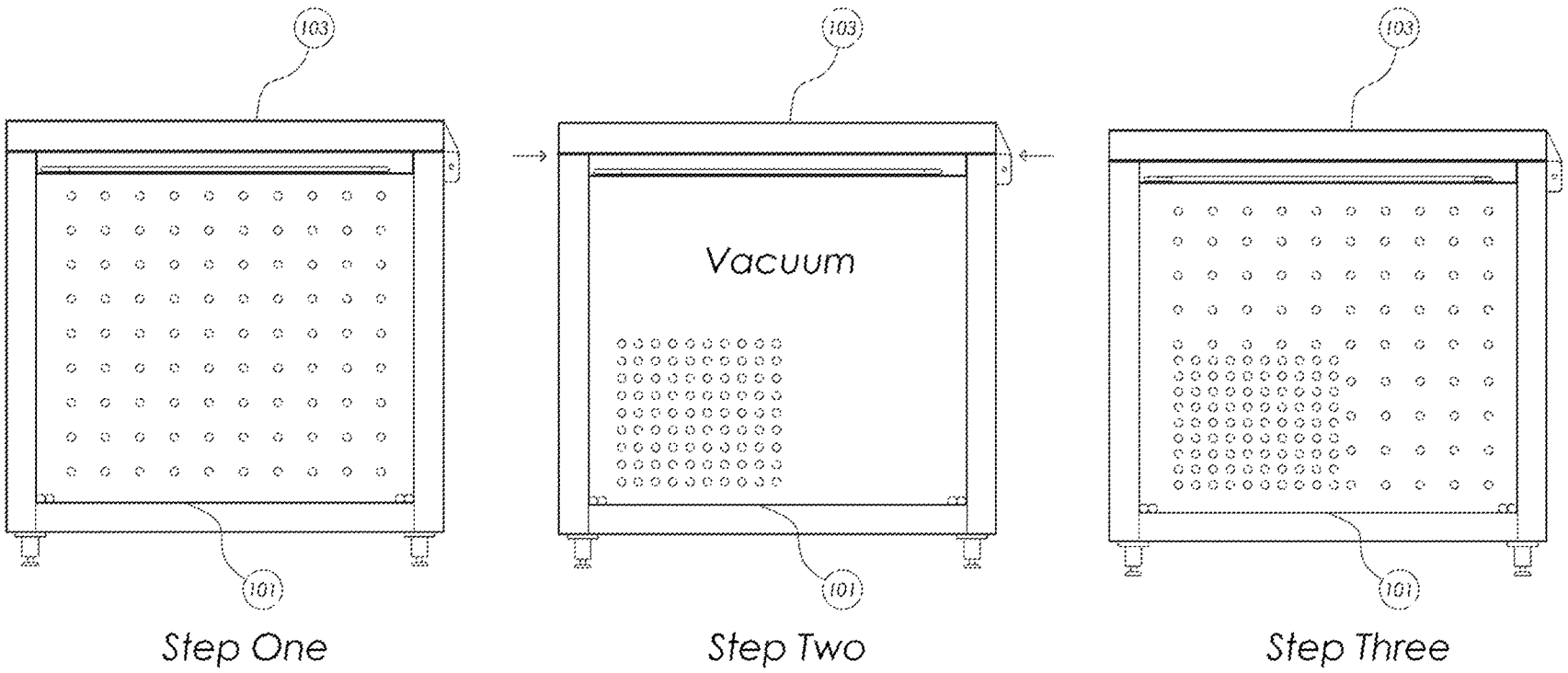
FIG. 11 is a progression diagram demonstrating airflow into the payload bay of prior art chest freezers.

Now referring to FIG. 11, the payload bay 101 is sealed shut by the lid 103. Step One shows a sealed prior art chest freezer at room temperature. Air particles are simulated by circles. Step Two shows the same prior art chest freezer but at its colder setpoint. The air particles within it are colder, and as such have become less dense, which is demonstrated by the more tightly packed circles. The empty area simulates a vacuum, which causes a sucking force, demonstrated by two arrows. This sucking force will cause ambient air at warmer temperatures to enter the payload bay 101. Step Three simulates the warmer air within the payload bay 101.

The warmer ambient air that enters the payload bay 101 brings humidity with it, which will freeze on the walls of the payload bay 101.

Figure 12:
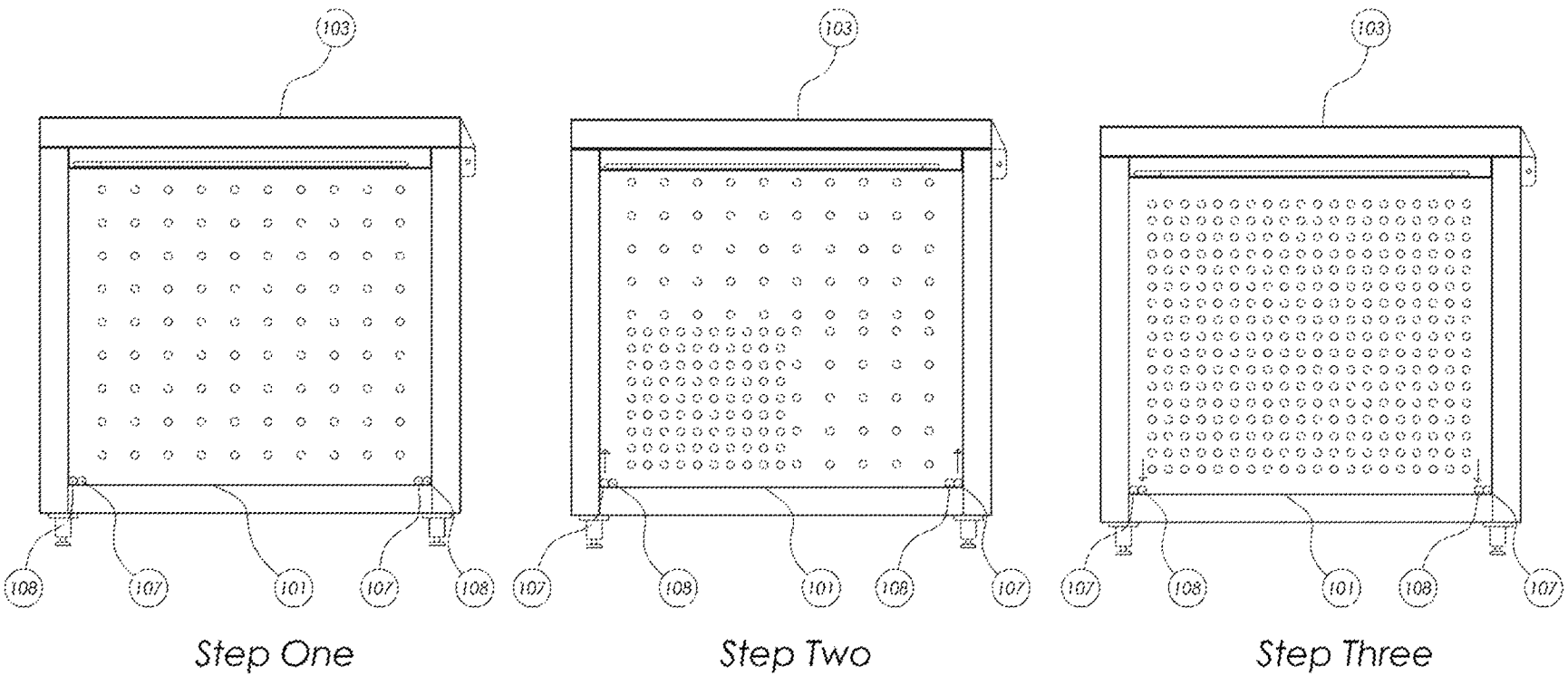
FIG. 12 is a progression diagram demonstrating the pressurization of the payload bay of one embodiment of the present invention to prevent moisture inflow.

Now referring to FIG. 12, the payload bay 101, is sealed shut by the lid 103. One or more purge inlet valves 107 and one or more over-pressurization relief valves 108 are placed within the payload bay 101. Step One shows the sealed present invention at room temperature. Air particles are simulated by circles. Step Two shows one embodiment at a colder setpoint. The original air within it is colder and denser, as simulated by the tightly packed circles. The one or more purge inlet valves 107 are expelling gaseous nitrogen into the payload bay 101 and is being used to pressurize the payload bay 101. This gaseous nitrogen is simulated by two arrows. No external air is entering into the payload bay 101. Step Three shows the embodiment completely full of air at its setpoint. Should the pressure within this embodiment exceed that deemed safe, the one or more over-pressurization relief valves 108 allow air to flow into them to equalize the pressure of the payload bay 101.

No external air enters the payload bay 101 which means that no additional moisture enters within the payload bay 101, reducing frost. One embodiment can reach its setpoint with the payload bay 101 safely pressurized and without moisture.

Figure 13:
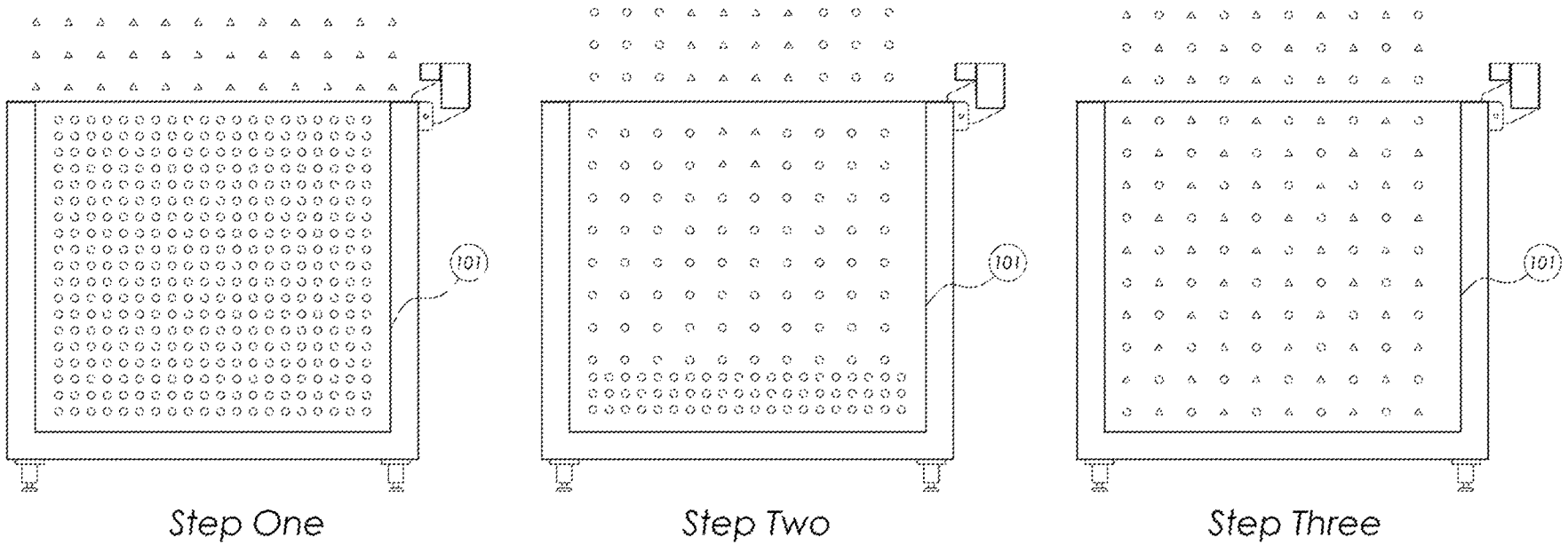
FIG. 13 is a progression diagram demonstrating moisture saturation of the atmosphere of the payload bay of prior art chest freezers during an open-door event.

Now referring to FIG. 13, the payload bay 101 is exposed directly to ambient air. Air originally within the freezer is simulated with circles while humid air is simulated by triangles. Step One shows a prior art chest freezer immediately after a door-open event. The air within it is at the setpoint at which it was set prior to the door-open event, simulated by the close spacing of the circles. Step Two simulates the same prior art chest freezer sometime after a door-open event has started. The air within the payload bay 101 is warming up, shown by the greater spacing between circles, and moist ambient air is slowly entering, simulated by the triangles entering the payload bay 101. Step Three simulates the same prior art chest freezer some more time after a door-open event has started. The moist air, or triangles, have completely intermixed with the original air, or circles. Moisture from the moist air has accumulated and frosted onto the interior walls of the payload bay 101, as simulated by the triangles directly adjacent to the walls of the payload bay 101.

Figure 14:
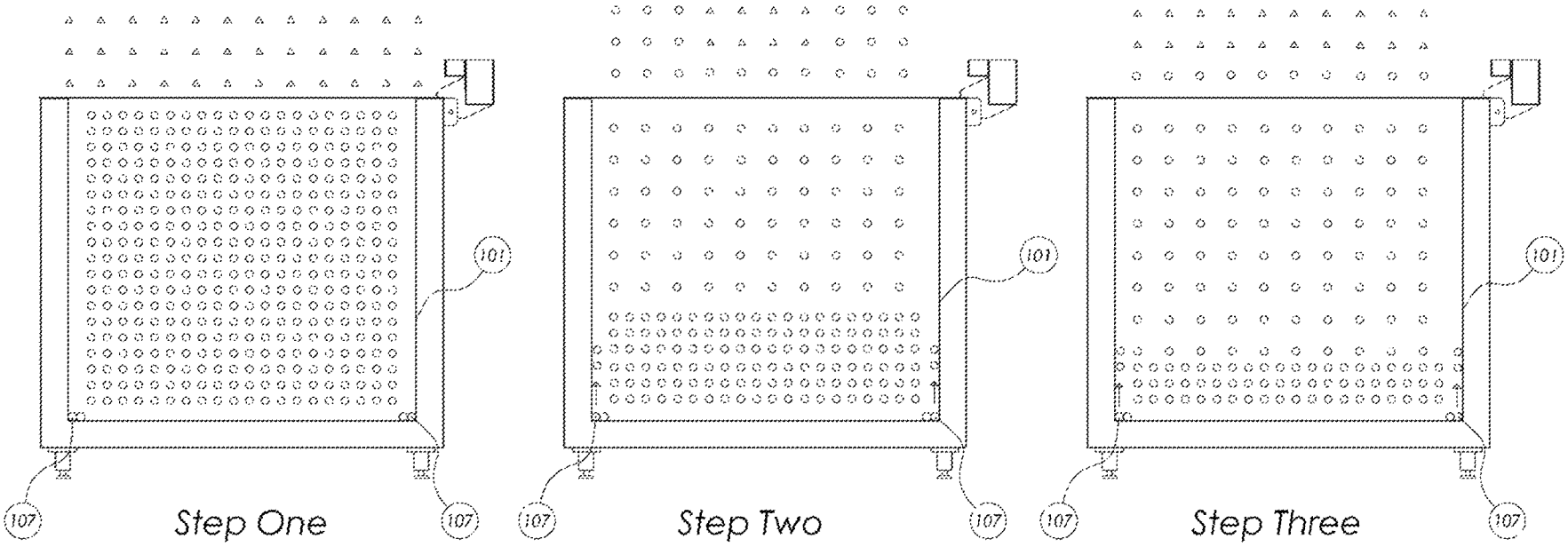
FIG. 14 is a progression diagram demonstrating the over-pressurization of the payload bay of one embodiment of the present invention to prevent moisture inflow during an open-door event.

Now referring to FIG. 14, the payload bay 101 is exposed directly to ambient air. One or more purge inlet valves 107 are within the payload bay 101. Step One shows one embodiment immediately after a door-open event. The air within it is at the setpoint at which it was set prior to the door-open event, simulated by the close spacing of the circles. Step Two simulates the embodiment sometime after a door-open event has started. The air within the payload bay 101 is warming up, shown by the greater spacing between circles. The one or more purge inlet valves 107 allow gaseous nitrogen at a cold temperature to enter the bottom of the payload bay 101. This colder, denser air settles at the bottom of the payload bay 101 and slowly expands as it warms up. This causes the air within the payload bay to spill upward and outward, holding the moist, ambient air at bay, which is simulated by triangles. Step Three simulates the embodiment some more time after a door-open event has started. The airflow within the payload bay 101 has reached equilibrium. The cold, gaseous nitrogen entering the payload bay 101 through the one or more purge inlet valves 107 slowly expands and causes air to spill out of the payload bay, holding off any moisture from entering the payload bay 101 and even purging any moisture already within the payload bay 101.

Figure 15:
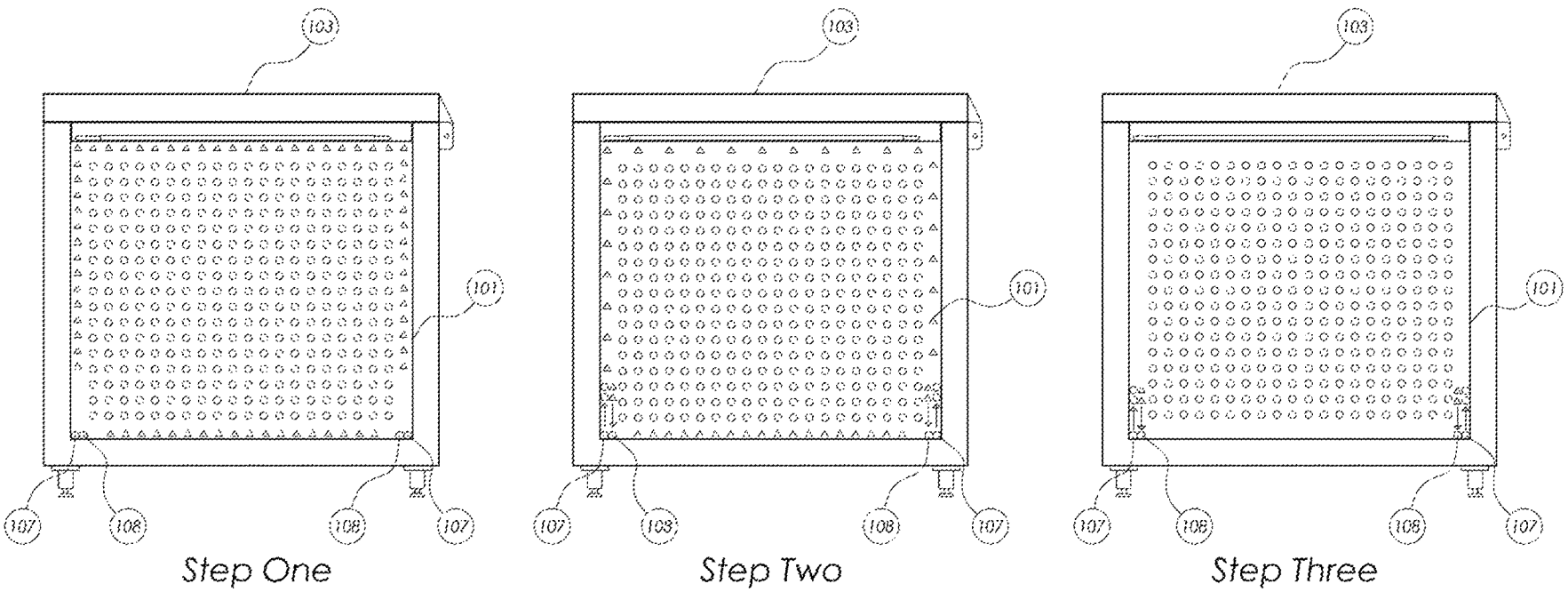
FIG. 15 is a progression diagram demonstrating the stripping of frost within the payload bay of one embodiment of the present invention.

Now referring to FIG. 15, the payload bay 101 is sealed shut by the lid 103. One or more purge inlet valves 107 and one or more over-pressurization relief valves 108 are within the payload bay 101. Step One shows one embodiment at its setpoint. Frost lines the interior surfaces of the payload bay 101. Step Two shows the embodiment sometime after Step One. The one or more purge inlet valves 107 allow gaseous nitrogen to enter the payload bay 101. This gaseous nitrogen is completely dry and causes the atmosphere of the payload bay 101 to increase. The one or more over-pressurization relief valves 108 allow the air from within the payload bay 101 to escape once it reaches above a certain pressure. As previously explained, solidified water will sublimate to reach its partial pressure. As the payload bay 101 is over-pressurized and de-pressurized in turn, dry air enters the payload bay 101 and then the air within the payload bay 101 leaves, decreasing the ice partial pressure. This causes the ice to sublimate to reach its partial pressure. The continual lowering of the ice partial pressure, or rather the continual atmospheric renewal with dry air, causes the ice to sublimate constantly. Thus, the system constantly defrosts and dehumidifies itself.

Figure 16:
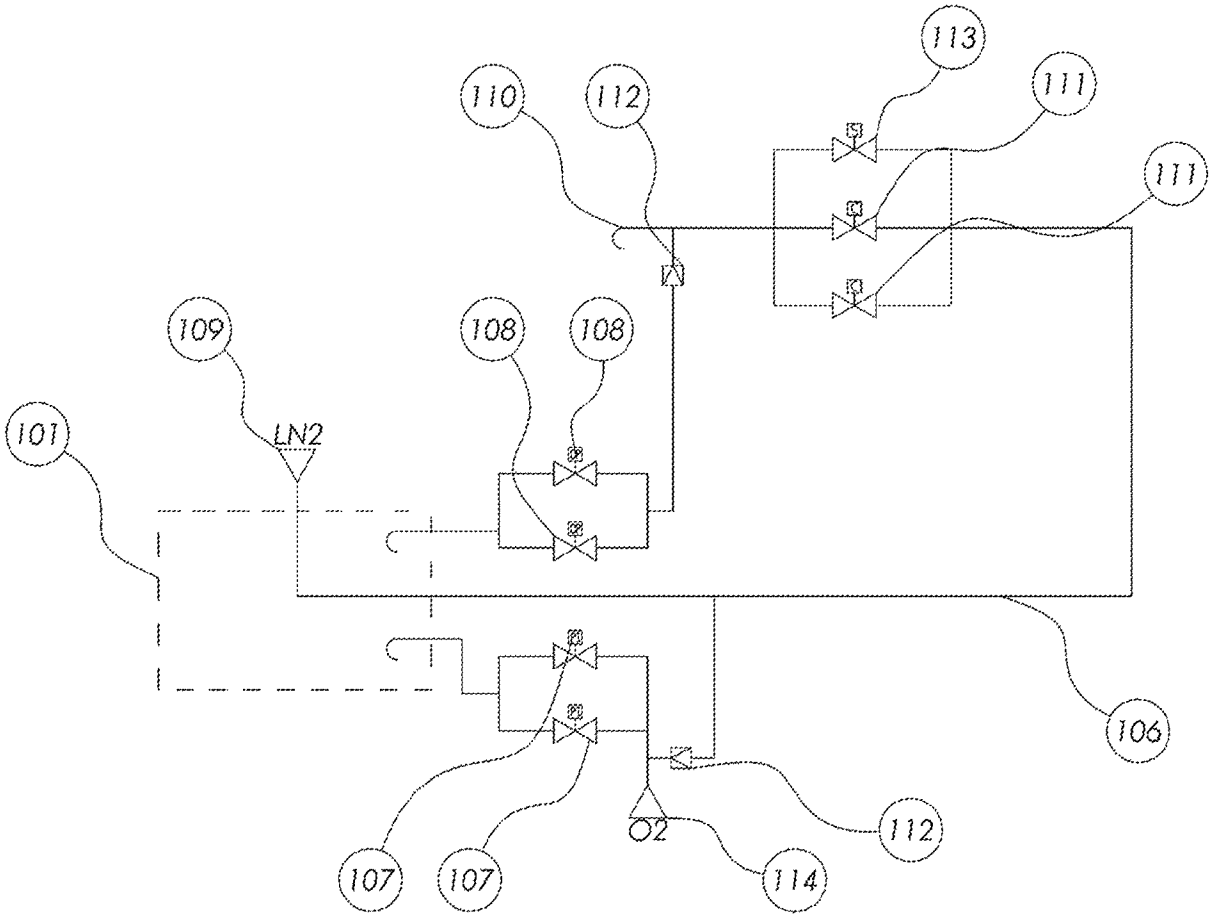
FIG. 16 is a plumbing diagram of one embodiment of the present invention.

Now referring to FIG. 16, the liquid nitrogen inlet 109 is attached to one or more coolant tubes 106. One or more cryogenic solenoid valves 111 control the flow of nitrogen through the one or more coolant tubes 106. One or more check valves 112 help control the direction of liquid nitrogen flow. The one or more coolant tubes 106 enter the payload bay 101. The nitrogen exits the one or more coolant tubes 106 at the exhaust outlet 110. A safety valve 113 is used to ensure that the pressure within the one or more coolant tubes 106 remain within safe levels. One or more over-pressurization relief valves 108 are used to allow air to flow from the payload bay 101 to the exhaust outlet 110. One or more purge inlet valves 107 are used to allow nitrogen flow into the payload bay 101.

It is dangerous for systems to release gas into air breathed by humans. One embodiment therefore utilizes an oxygen source 114 that mixes with the nitrogen going into the payload bay 101 through the one or more purge inlet valves 107. This eliminates possibility of suffocation.

While there have been shown what are presently considered to be preferred embodiments of the present invention, it will be apparent to those skilled in the art that various changes and modifications can be made herein without departing from the scope and spirit of the invention.

What is claimed is:

1. An ultra-low temperature chest freezer, comprising:

a payload bay;

a lid attached to the payload bay;

an evaporator housing attached on an underside of the lid, such that the evaporator housing is within the payload bay when the lid is closed and is coupled to an atmosphere within the payload bay;

one or more evaporators within the evaporator housing thermally coupled to one or more coolant tubes;

a liquid nitrogen inlet and an exhaust outlet attached to the one or more coolant tubes to allow nitrogen flows into the liquid nitrogen inlet through the one or more coolant tubes, and out of the exhaust outlet;

one or more cryogenic solenoid valves and one or more check valves that control nitrogen flows within the one or more coolant tubes;

one or more purge inlet valves within the payload bay that allow nitrogen flows from the one or more coolant tubes directly into the payload bay; and one or more over-pressurization relief valves within the payload bay that allow air flows from the payload bay to the exhaust outlet.

2. The freezer of claim 1, wherein the payload bay and the lid comprise insulation to reduce heat gain from an outside environment.

3. The freezer of claim 1, wherein the evaporator housing is coupled to the atmosphere within the payload bay with one or more interstitial holes, one or more staggered holes, and a screen.

4. The freezer of claim 1, wherein the payload bay and the lid, when shut, are airtight and prevent airflow within the payload bay.

5. The freezer of claim 1, wherein the one or more coolant tubes are placed in series or in parallel.

6. The freezer of claim 1, wherein the one or more check valves restrict air flows from the one or more coolant tubes into the payload bay through the one or more over-pressurization relief valves.

7. The freezer of claim 1, further comprising an oxygen source coupled to the one or more purge inlet valves to mix oxygen with nitrogen prior to entering the payload bay.

8. The freezer of claim 7, wherein the one or more check valves restrict oxygen from entering the one or more coolant tubes.

9. The freezer of claim 1, wherein liquid nitrogen is evaporated to gaseous nitrogen within the one or more coolant tubes and directed to one or more purge inlet valves by the one or more cryogenic solenoid valves.

10. The freezer of claim 1, wherein the one or more purge inlet valves release gaseous nitrogen into the payload bay to over-pressurize the payload bay prior to a door-open event to prevent airflow into the payload bay.

11. The freezer of claim 1, wherein the one or more purge inlet valves release gaseous nitrogen into the payload bay during a door-open event to prevent moisture from entering the payload bay.

12. The freezer of claim 1, wherein the one or more purge inlet valves release gaseous nitrogen into the payload bay while the payload bay is sealed to dehumidify and defrost the payload bay.

13. The freezer of claim 12, wherein the gaseous nitrogen in the payload bay exits through the one or more over-pressurization relief valves.

* * * * *